United States Patent [19]

Van Sickle

[11] 4,381,791

[45] May 3, 1983

[54] PERMANENT WAVE MANDREL DEVICE FOR HAIR

[76] Inventor: Jean Van Sickle, 802 23rd St., Vienna, W. Va. 26105

[21] Appl. No.: 191,823

[22] Filed: Sep. 26, 1980

[51] Int. Cl.[3] ..... A45D 2/00

[52] U.S. Cl. ..... 132/40

[58] Field of Search ..... 132/40, 41, 42 R, 42 A, 132/39

[56] References Cited

U.S. PATENT DOCUMENTS

| | | | |
|---|---|---|---|
| 564,611 | 7/1896 | Gilmore | 132/43 R |
| 2,013,258 | 9/1935 | Vecchio | 132/41 |
| 2,106,326 | 1/1938 | McFadden | 132/36.1 |
| 2,381,107 | 8/1945 | Calabro | 132/42 A |
| 2,732,845 | 1/1956 | Winkler | 132/42 |
| 2,862,508 | 12/1958 | Campbell | 132/41 R |
| 2,874,706 | 2/1959 | Ficicchy | 132/42 R |
| 3,045,685 | 7/1962 | Cormier | 132/42 R |
| 3,144,027 | 8/1964 | Chalfin et al. | 132/40 |
| 3,241,561 | 3/1966 | Richmond | 132/40 |
| 3,388,709 | 6/1968 | Morris | 132/42 |
| 3,500,837 | 3/1970 | Ferens | 132/40 |
| 3,572,350 | 3/1971 | Adams et al. | 132/39 |
| 3,717,156 | 2/1973 | McKeown | 132/40 |
| 4,240,451 | 12/1980 | Thompson | 132/42 A |

*Primary Examiner*—G. E. McNeill

*Attorney, Agent, or Firm*—Berman, Aisenberg & Platt

[57] ABSTRACT

An improved permanent wave, mandrel device for hair, in which a small diameter rod forms a mandrel for rolling a tight curl of hair, the hair curl being pressed against the rods by an elastic cord stretched from one end of the rod to the other, and in which the improvement embodies the addition of a sponge member, preferably in the form of a cylinder surrounding the elastic cord and a portion of which is positioned between the cord and the curled hair to distribute the applied pressure more widely and prevents breakage of hair strands.

10 Claims, 3 Drawing Figures

FIG. 1
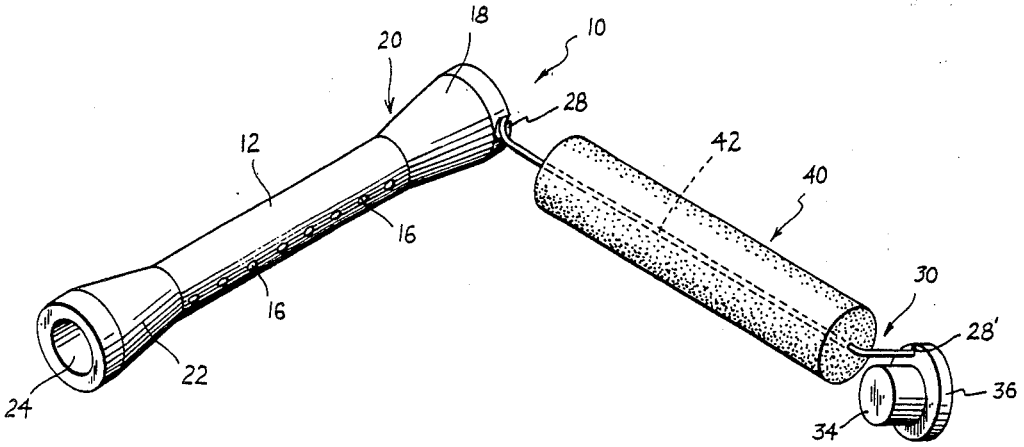
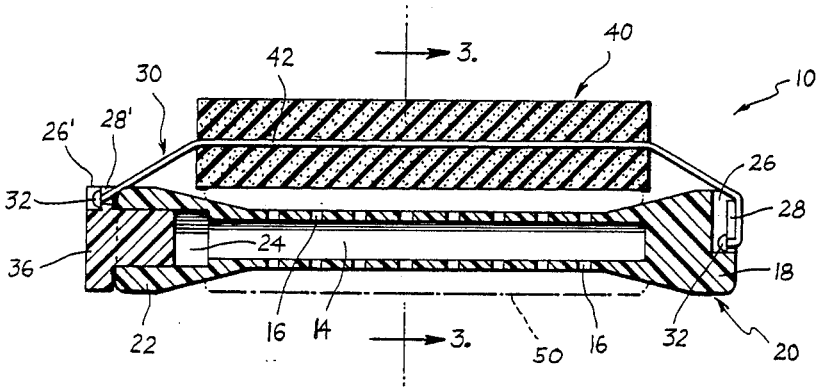
FIG. 2
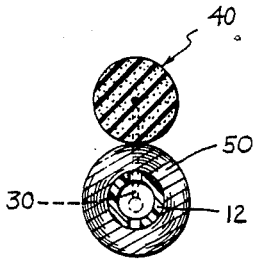
FIG. 3

PERMANENT WAVE MANDREL DEVICE FOR HAIR

BACKGROUND OF THE INVENTION

1. Field of the Invention

The invention relates to the art of hair curling, and more particularly to an improved permanent wave, mandrel device which includes a sponge member positioned between the elastic cord and the hair curled on the mandrel so as to distribute more widely the pressure applied to the curl.

2. The Prior Art

To understand the art of permanently waving hair, it is necessary to understand the nature of hair. Hair is manufactured by the body and is mainly formed of protein with some water and natural oil present. A hair strand as it grows in its follicle comprises about 6 to 10 outer circular layers, called a cuticle which surrounds an inner portion, or cortex, formed by many fibers of protein bonded together like a hemp rope. Hair growing from the follicle, at about the rate of ½ inch per month, undergoes a major change called keratinization about ⅓ of the way up the follicle canal. This is a change from soft living protein to hard, resistant non-living protein as occurs in human nails, animal horns, hooves and feathers. Keratinization renders the hair water insoluble and very resistant to chemical action.

The large protein molecules of the hair strand are joined together by electrical and chemical forces. Two of these forces are important to permanent waving. The first, called the "primary bond", is very strong and its position in the hair was established when the hair was formed. The next group of bands holding the protein molecules together are called "secondary bands". These are very weak bands which can be opened by water and this is the basis for temporary waving as by wet setting the hair. When hair is wet, the secondary bands are neutralized and the hair is soft. If the hair is then dried in a selected shape using a roller, pin, or comb, it will retain this shape as long as the hair is relatively dry since the secondary bands will hold the shifted position. But when the hair is rewet, the stronger primary bands take over and the hair reverts to its natural shape.

The only way to achieve a so-called permanent wave (lasting 2½–3 months) is to change the position of the primary bands by exercizing a force with greater strength. Thus all permanent waving whether done by machine or by hand, by hot or cold methods, must perform three actions:

1. Open the primary bond (usually accomplished by a strong chemical curling lotion).
2. Shift the position of these opened bond ends, (usually accomplished by rolling the hair on a spindle or rod).
3. Reform the primary bands in the new shifted position (usually accomplished by a reforming chemical called a neutralizer.

Customarily the hair is cut and shaped before applying the three steps above. The hair is then moistened with the chemical curling lotion, usually thioglycolie acid (thio) or a derivative. If necessary, heat from a hair dryer is applied. This is the start of action 1.

Groups of hair strands locks are then individually rolled on small diameter spindles called "perm rods". Two pieces of paper are used with each lock of hair, one above and one below. The paper beyond the ends of the hair strands are rolled over the rod and subsequently the hair between the papers are rolled with the papers about the rod. This is continued beyond the papers as far as one can roll up to the scalp with the hair exposed around the rod and papers. In today's fashion generally involving shorter hair lengths, it is essential to roll the hair completely to the scalp. This is especially essential when creating poodle and "afro" hair styles and all other styles except those involving curling only the ends of the hair. An elastic band is then inserted across the length of the "perm rod" clamping the hair tightly, creating tension on the hair and a pulling sensation. All of the selected locks of hair are rolled on "perm rods" in this way, the number, positions, size of the perm rod, and directions of rolling depending upon the style of permanent desired. The described rolling on rods shifts the position of the opened bands along the hair strands.

The neutralizer lotion is applied to the hair curls around the rods and this hardens the hair to set the curls around the rods.

To complete the permanent, the rods are removed. A setting lotion is often applied to the hair curls. Depending on the style of permanent wanted, it may be that some hair locks will need to be rolled on larger diameter mandrels, usually called curlers. The head is then placed under a drier to dry the hair. Finally the curlers are removed and the hair is brushed and combed into the desired style.

One of the disadvantages of the conventional method and apparatus for permanent hair waving described above, is that the chemical curling lotion in acting on the hair rolled about the perm rod gives off heat which expands and softens the hair strands at the same time the elastic band holding the curl presses the curl tightly against the rod in a narrow area corresponding to the area of the band. Thus the force of the heat and the force of the band pressure together cause a crease in the softened hair. When the neutralizer is applied, the hair is hardened and damage occurs in the creased portions. Hair which has not been previously treated with strong chemicals (sometimes called virgin or 'downy' hair) retains its elasticity. However, when it is treated with strong chemicals so as to achieve a long-lasting permanent by presently known available commercial methods, the hair is damaged and breaks by the creasing and hardening of the hair. Bleaching and tinting causes the hair to lose much of its natural elasticity and causes it to be much more susceptible to damage from the use of commerical chemical waving methods. Therefore, the use of conventional 'perm rods' to give a permanent causes damage and breakage of the hair, and if the person has bleached or tinted hair, it is likely to cause very serious damage, including a very large number of broken short hairs.

SUMMARY OF THE INVENTION

The present invention overcomes the defects and disadvantages of conventional hair wave mandrel devices as briefly outlined above, by encasing the elastic cord on the perm rod in a sponge-like material that distributes the tension more widely across the hair curl to prevent serious damage and breakage of the hair. Another function of the sponge material is to absorb excess waving solutions and prevent such excess chemicals from running to the scalp, or off the head.

From the above, it should be noted that a primary object of the invention is to provide an improved permanent wave mandrel device incorporating a pressure pad which separates the hair from the elastic cord holding the hair curl, so as to distribute the tension more widely and prevent hair damage and breakage.

Another important object of the invention is to provide an improved permanent wave mandrel device, having the above described characteristics, in which the pad of sponge material also functions to absorb excess chemical curling agents, hold them next to the hair to yield a better permanent, and prevent such excess solutions from running to the scalp or off the head.

A still further important object of the invention is to provide an improved hair wave mandrel device, having the above described characteristics, in which the sponge pad is so effective to reduce hair damage that permanents can be safely given to persons having hair injured by previous bleaching and tintings without danger of further damage.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, well best be understood from the following description of a specific embodiment, when read in connection with the accompanying drawings, wherein like reference characters indicate like parts throughout the several figures, and in which:

FIG. 1 is a perspective view of a permanent wave mandrel device according to the invention, with the elastic cord unhooked at one end and the mandrel ready to receive a lock of hair to be rolled thereon;

FIG. 2 is a longitudinal section of the mandrel device with the elastic cord hooked on over a curl, the hair curl outline being shown in broken lines; and FIG. 3 is a sectional view taken along line 3—3 of FIG. 2 and looking in the direction of the arrows.

DESCRIPTION OF THE PREFERRED EMBODIMENT

Referring now more particularly to the drawings, the improved permanent wave mandrel device of the invention is exemplified in one preferred embodiment generally referred to as comprising the combination of a more or less conventional perm rod 20 and elastic cord 30 with a novel pressure distributing pad 40.

The perm rod 20 normally is fashioned as a small diameter tubular rod 12 having a bore 14 and several series of apertures 16 which permit ingress and egress of chemical waving solutions to and from the bore of the mandrel. Conventionally, the mandrel 20 is formed of a rigid plastic material and is of small diameter in tube portion 12 varying from about $\frac{1}{4}$ inch to $\frac{5}{8}$ inch to enable the hair to be rolled thereon in a small tight curl. The ends of rod 12 are extended by integral, similar, short, conical enlargements, 18 and 22. Conical portion 18 is solid while conical portion 22 has an enlarged bore 24 communicating with bore 14.

The elastic cord 30 is removably secured to end portion 18 by an enlargement or button 32 which passes along and seats in slot 26, the cord itself passing through adjacent and narrower slot 28. A stopper 34 having an enlarged head 36 is provided for plugging bore 24 at the opposite end 22 of the mandrel 20. The plug head 36 is provided with a pair of adjacent wide and narrow slots 26', 28' similar to slots 25, 28 and which removably secure the opposite end of elastic cord 30 by its button 32. After the hair curl has been wound on the mandrel, the plug 34 is inserted in bore 24 to clamp the curl.

The novel pressure distributing pad 40 of the present invention is here illustrated in its preferred form as a cylinder having an axial bore 42 through which the elastic cord 30 is threaded prior to forming or securing the end enlargements 32, 32. The pad 40 is thus firmly fixed to the elastic cord and when the cord is stretched and clamped over the hair curl 50 as shown in FIGS. 2 and 3, the pressure applied to the curl is spread over a wider area than the area of the cord alone, thus reducing the pressure per unit area and preventing the creasing and the breaking of hair strands. The tubular pad may be formed of a rigid plastic and still yield the desired function of distributing and lessening pressure per unit area but it is preferred to form pad 40 of sponge rubber or a foam plastic such as polyurethane whereby not only is the pressure lessened but the pad is capable of absorbing and holding excess chemical hair waving solutions, and preventing the excess from running on to the scalp or off the head of the person whose hair is being waved.

The manner of using the described mandrel device is more or less obvious and practically the same as the mode of using conventional perm rods which do not have a pressure reducing pad. As explained above under "Prior Art" the individual locks of hair are each wetted with a chemical waving lotion and wound around rod 12 with the cord 30 and pad 40 in open non-clamping condition, as shown in FIG. 1. The cord 30 is then stretched sufficiently to insert plug 34 in the end 22 of the mandrel device thus clamping the hair curl, as portrayed in FIGS. 2 and 3, with the pad 40 between the elastic cord and the hair. The pressure is thus distributed over a wide area and the danger of hair injury lessened. After sufficient time the neutralizer lotion is applied directly to each hair curl, and if desired also to the pad 40. The mandrel device is subsequently removed from the hair curl by pulling out plug 34 and unwinding the hair from the rod 12. Subsequent steps to complete the desired style of permanent wave may then be taken such as wetting the hair, winding some locks on curlers (larger diameter than perm rods), drying, brushing and combing.

While the preferred and described embodiment of the invention utilizes a tubular pressure pad 40, it should be obvious that other shapes of pad and other means of securing the pad between the elastic cord and hair curl may be easily used. Similarly the specific structures of the mandrel 20, plug 34 and means of securing the elastic cord to the mandrel may obviously be changed.

Although a certain specific embodiment of the invention has been shown and described, it is apparent that many modifications thereof are possible. The invention therefore, is not intended to be restricted to the exact showing of the drawings and description thereof, but is considered to include reasonable and obvious equivalents.

What is claimed is:

1. A permanent wave, mandrel device for hair, comprising a rod having an outside surface on which hair is to be rolled to form a curl, an elongated pressure element extending along said rod and adapted to press the hair curl tightly against the outside surface of the rod to thereby maintain said hair in a curl about said rod, and a pad adapted to be positioned between the pressure element and the outside surface of the curl and extending substantially along the length of said rod to cushion the pressure applied to the outside surface of the curl by the pressure element so as to prevent damage to hair strands.

2. A permanent wave device according to claim 1, wherein said pressure element is an elastic cord having two ends and extending from near one end of the rod to near the other end.

3. A permanent wave device according to claim 2, wherein said pad is made of a sponge material.

4. A permanent wave device according to claim 3, wherein said pad is a cylinder which encircles said cord.

5. A permanent wave device according to claim 3, wherein said pad is made of rubber.

6. A permanent wave device according to claim 3, wherein said pad is made of plastic foam.

7. A permanent wave device according to claim 3 wherein said rod is a tube made of plastic.

8. A permanent wave device according to claim 7, wherein said rod has a central portion having a small diameter and end portions having larger diameters, and means for removably securing each of said ends of said elastic cord to each of said end portions.

9. A permanent wave device according to claim 8, wherein said means for securing has a pair of adjacent slots of different widths at each end of the rod, the slot of smaller width passing the elastic cord therethrough and the slot of larger width passing and holding an enlargement on the end of the cord.

10. A permanent wave device according to claim 9, wherein one of said pairs of slots is formed in a plug member which fits into a bore in the enlargement at one end of the rod.

* * * * *